US010232277B2

(12) United States Patent
Mueller

(10) Patent No.: US 10,232,277 B2
(45) Date of Patent: Mar. 19, 2019

(54) TOY VEHICLE SYSTEM

(71) Applicant: Martin Mueller, Speyer (DE)

(72) Inventor: Martin Mueller, Speyer (DE)

( * ) Notice: Subject to any disclaimer, the term of this patent is extended or adjusted under 35 U.S.C. 154(b) by 0 days.

(21) Appl. No.: 15/823,391

(22) Filed: Nov. 27, 2017

(65) Prior Publication Data

US 2018/0078868 A1 Mar. 22, 2018

Related U.S. Application Data

(63) Continuation of application No. PCT/EP2016/000882, filed on May 27, 2016.

(30) Foreign Application Priority Data

May 26, 2015 (DE) ..... 20 2015 003 807 U

(51) Int. Cl.
*A63H 17/00* (2006.01)
*A63H 33/00* (2006.01)
(Continued)

(52) U.S. Cl.
CPC ..... *A63H 17/395* (2013.01); *A63H 17/262* (2013.01); *A63H 17/36* (2013.01); *A63H 30/04* (2013.01)

(58) Field of Classification Search
CPC ..... A63H 17/00; A63H 17/26; A63H 17/262; A63H 17/36; A63H 30/00; A63H 17/395
See application file for complete search history.

(56) References Cited

U.S. PATENT DOCUMENTS 4,213,270 A * 7/1980 Oda ..... A63H 17/36 446/456
4,810,229 A * 3/1989 Shoji ..... A63H 17/262 446/443

(Continued)

FOREIGN PATENT DOCUMENTS

CN 204337744 U 5/2015

OTHER PUBLICATIONS

International Search Report dated Dec. 8, 2016 of international application PCT/EP2016/000882 on which this application is based.

*Primary Examiner* — Gene Kim
*Assistant Examiner* — Alyssa Hylinski
(74) *Attorney, Agent, or Firm* — Walter Ottesen, P.A.

(57) ABSTRACT

A toy vehicle system includes a toy vehicle, a remote-control transmitter and a control unit. The toy vehicle includes a drive with at least two drive motors and at least two roller elements. The roller elements are mutually independently driven rotationally about respective axes of rotation via the drive motors. The toy vehicle further includes at least one steering mechanism for adjusting the directions of orientation of the axes of rotation relative to the longitudinal axis of the vehicle. Input signals of the remote-control are fed into the control unit. The control unit generates output signals that act on the drive and the steering mechanism. In the operating method, the control unit carries out a computational driving simulation and generates therefrom control output signals such that the toy vehicle carries out a vehicle movement according to the computational driving simulation under the action of a virtual operating frictional force.

26 Claims, 4 Drawing Sheets

(51) Int. Cl.

| | |
|---|---|
| ***A63H 17/395*** | (2006.01) |
| ***A63H 30/04*** | (2006.01) |
| ***A63H 17/36*** | (2006.01) |
| ***A63H 17/26*** | (2006.01) |

(56) References Cited

U.S. PATENT DOCUMENTS

| | | | | |
|---|---|---|---|---|
| 5,609,510 | A | 3/1997 | Stubenfoll et al. | |
| 5,924,512 | A * | 7/1999 | Wada | B62D 1/28 180/23 |
| 8,142,254 | B1 * | 3/2012 | Greenley | A63H 29/22 446/431 |
| 2005/0181703 | A1 * | 8/2005 | Kuralt | A63H 17/36 446/454 |
| 2008/0268747 | A1 | 10/2008 | Moulton | |
| 2012/0253554 | A1 | 10/2012 | Hamilton | |
| 2013/0109272 | A1 * | 5/2013 | Rindlisbacher | A63H 30/04 446/454 |
| 2014/0227941 | A1 | 8/2014 | Suzuki | |

* cited by examiner

Fig. 7
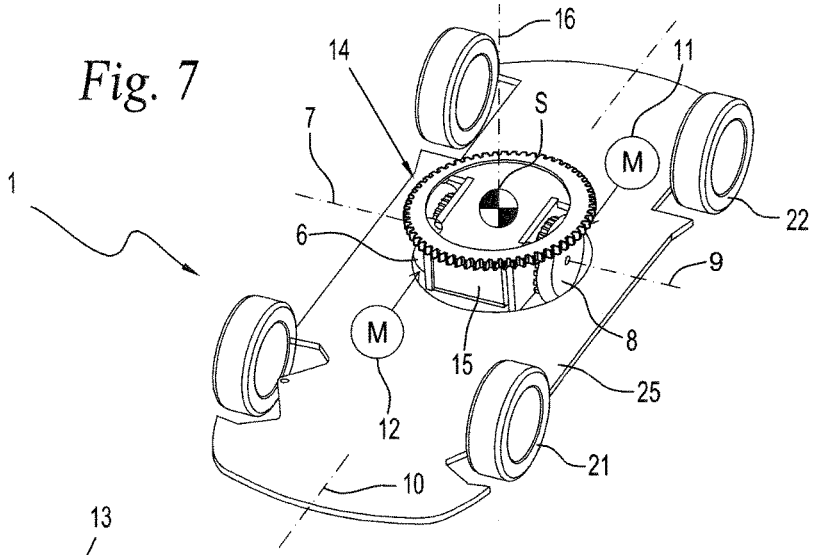
Fig. 8
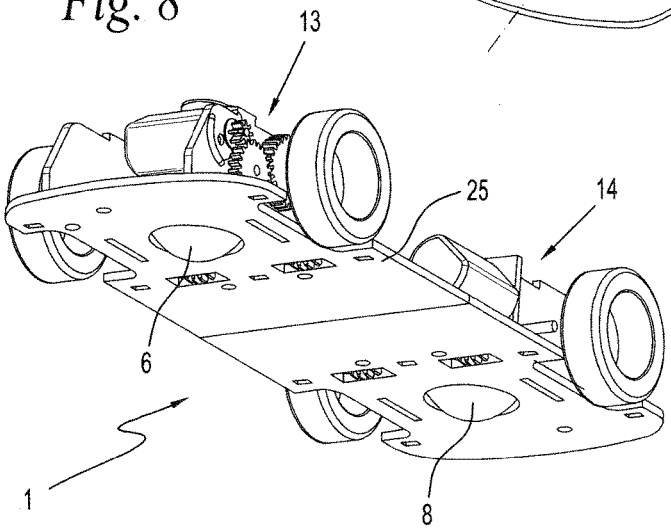
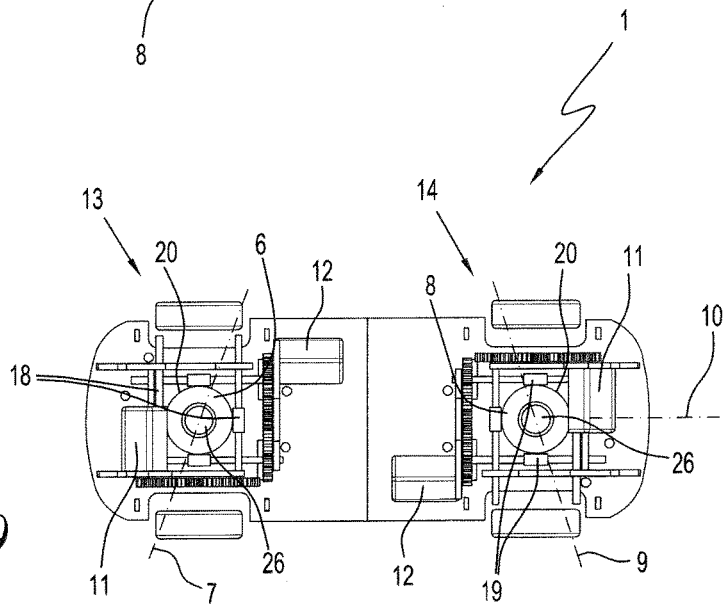
Fig. 9

TOY VEHICLE SYSTEM

CROSS REFERENCE TO RELATED APPLICATIONS

This application is a continuation application of international patent application PCT/EP2016/000882, filed May 27, 2016 designating the United States and claiming priority from German application 20 2015 003 807.7, filed May 26, 2015, and the entire content of both applications is incorporated herein by reference.

BACKGROUND OF THE INVENTION

Toy or model vehicles are widely used in numerous variations. For the operation, the user actuates a remote-control transmitter. The control output signals thereof are as a general rule transmitted over a radio path to a receiver of the toy vehicle and are converted there into a corresponding driving movement. In this case, the significant control functions consist of a right-left control and the setting of a setpoint vehicle speed including acceleration and deceleration.

The toy vehicle itself is modeled in the basic technical features thereof on the usual configuration of a motor vehicle: in the general case, the front and rear axles are provided with a total of four wheels, wherein one of the axles, in most cases the front axle, is steerable. At least one of the wheels is driven via a drive motor, via which the toy vehicle can be accelerated. Conversely, a brake mechanism is also provided for deceleration. In the case of an electric drive, the acceleration and the deceleration can be exerted with the same electric motor in motor mode on the one hand and in generator mode on the other hand. In any case, cornering, accelerations and/or decelerations can result in at least some of the wheels transmitting frictional forces to the ground in the longitudinal and/or lateral direction. So that the toy vehicle does not skid on the ground, the wheels include tires made of rubber, elastomeric plastics or similar materials.

In practical operation, it has been shown that such remote-control toy vehicles are difficult to control. Even at only low drive power, speeds and above all accelerations can be achieved that hardly relate to the available space conditions for example in a living room. Unless an actual designated model racing track is available, staging a vehicle race is only possible with difficulty. Collisions and breakages can hardly be avoided. Moreover, the achievable speeds and accelerations are not in proportion to the small size of the toy vehicle, even from the visual appearance viewpoint, so there is a rather unrealistic driver impression when operating. Voluntary limiting of the acceleration and speed is indeed sometimes possible, but this restricts the driving dynamics in such a way that the attraction of operating a toy vehicle that is limited in this way is lost.

SUMMARY OF THE INVENTION

It is an object of the invention to provide a toy vehicle system so that a realistic impression of driving under drift conditions can be imparted, even under tight spatial conditions.

This object can, for example, be achieved by a toy vehicle system including: a toy vehicle defining a longitudinal vehicle axis; a remote control transmitter; the toy vehicle having a drive including at least a first drive motor and a second drive motor; the toy vehicle further having at least a first roller element and a second roller element configured to transfer friction forces and drive torque to a ground; the first roller element defining a first rotational axis; the second roller element defining a second rotational axis; the first and second roller elements being configured to be independently driven about respective ones of the first rotational axis and the second rotational axis; at least one steering device configured to adjust an orientation direction of the first rotational axis and the second rotational axis relative to the longitudinal vehicle axis; and, a control unit configured to receive control input signals from the remote control transmitter and to generate control output signals configured to act on the first drive motor, the second drive motor and the at least one steering device.

It is a further object of the invention to provide a generic toy vehicle system such that a dynamically acting and yet controllable driving mode is possible, even under tight spatial conditions.

This object can, for example, be achieved by a toy vehicle system including: a toy vehicle having a drive with roller elements configured to transfer frictional forces to a ground and a steering device; a remote control transmitter; a control unit configured to receive control input signals from the remote control transmitter and to generate control output signals configured to act on the drive and on the steering device; the control unit being configured to call up a virtual adhesive force limit $F_m$ as well as a virtual frictional force $F_g$ between the toy vehicle and the ground; the virtual adhesive force limit $F_m$ being smaller than a corresponding actually transferable maximum frictional force between the first roller element and the second roller element and the ground; the virtual frictional force $F_g \leq$ the virtual adhesive force limit $F_m$; the control unit being configured for a computational driving simulation with incorporation of the control input signals of the remote control transmitter such that: the control unit computationally determines an uncorrected operational frictional force $F_b$ acting between the toy vehicle and the ground, and compares the uncorrected operational frictional force to the virtual adhesive force limit; wherein, in a normal mode, in which the computationally determined uncorrected operational frictional force $F_b$ is less than the virtual adhesive force limit $F_m$, a driving behavior of the toy vehicle is computationally simulated under local action of a virtual operating force $F_v$ at the level of the uncorrected operational friction force $F_b$; wherein, in a skidding mode, in which the computationally determined uncorrected operational frictional force $F_b$ is greater than the virtual adhesive force limit $F_m$, the driving behavior of the toy vehicle is simulated under local action of a virtual operating force at the level of the virtual frictional force $F_g$; and, the control unit is further configured to, from the computational driving simulation, generate control signals and have them act on the drive with the first roller element and the second roller element as well as the at least one steering device such that the toy vehicle performs a driving motion according to the computational driving simulation under action of the virtual operating force $F_v$.

It is a further object of the invention to specify an operating method for a toy vehicle system, via which a model vehicle can be operated dynamically and yet controllably, even under tight spatial conditions.

This object can, for example, be achieved by a method of operating a toy vehicle system. The toy vehicle system includes a toy vehicle having a drive with roller elements configured to transfer frictional forces to a ground and a steering device, a remote control transmitter, a control unit configured to receive control input signals from the remote control transmitter and to generate control output signals configured to act on the drive and on the steering device, the control unit being configured to call up a virtual adhesive force limit $F_m$ as well as a virtual frictional force $F_g$ between the toy vehicle and the ground, the virtual adhesive force limit $F_m$ being smaller than a corresponding actually transferable maximum frictional force between the first roller element and the second roller element and the ground, the virtual frictional force $F_g \leq$the virtual adhesive force limit $F_m$; and, the control unit being configured for a computational driving simulation with incorporation of the control input signals of the remote control transmitter such that the method comprises the steps of: computationally determining an uncorrected operational frictional force $F_b$ acting between the toy vehicle and the ground via the control unit; comparing the uncorrected operational frictional force to the virtual adhesive force limit; computationally simulating, in a normal mode wherein the computationally determined uncorrected operational frictional force $F_b$ is less than the virtual adhesive force limit $F_m$, a driving behavior of the toy vehicle under local action of a virtual operating force $F_v$ at the level of the uncorrected operational friction force $F_b$; simulating, in a skidding mode wherein the computationally determined uncorrected operational frictional force $F_b$ is greater than the virtual adhesive force limit $F_m$, a driving behavior of the toy vehicle under local action of a virtual operating force at the level of the virtual frictional force $F_g$; and, generating control signals from the computational driving simulation via the control unit and having them act on the drive with the first roller element and the second roller element as well as the at least one steering device such that the toy vehicle performs a driving motion according to the computational driving simulation under action of the virtual operating force $F_v$.

The invention is firstly based on the knowledge that a toy vehicle can be significantly smaller than a motor vehicle for carrying people, but that certain physical parameters do not follow such a reduction. In particular, the latter concerns two parameters of the physics of driving, namely the acceleration due to gravity g and the coefficient of friction p. The acceleration due to gravity g can be assumed to be constant. The coefficient of friction acting between the wheels and the ground varies from vehicle to vehicle, but essentially lies within the same order of magnitude. The result of this is that the horizontal accelerations (longitudinal acceleration, deceleration, centripetal acceleration when cornering) achievable with different vehicles are at least approximately the same, and this is completely independent of the actual size of the vehicle.

The invention is further based on the knowledge that with vehicles becoming smaller the available motor power and/or brake power relative to size of vehicle rises out of proportion. This means that for toy vehicles of the usual size the physics of driving are determined less by the drive power and/or brake power, but rather by the available frictional force between the wheels and the ground. Under these circumstances, with a small toy vehicle, using the adhesion limit, horizontal accelerations can thus be achieved that are of the same order of magnitude as for a large vehicle. In the case for example of a toy vehicle reduced to a scale of 1:10, braking decelerations can be achieved that are 10 times those of the original vehicle when scaled to the size of the model vehicle. Logically, the same also applies to centripetal accelerations when cornering, so that the actual physics of driving acting on the toy vehicle do not experience a scale reduction as for the vehicle itself. As a result, this means that certain operating state limits, at which adhesion is exceeded and the toy vehicle starts to skid, only occur at excessive accelerations and excessive cornering speeds. However, it is just the operating state limits that form the appeal of a toy vehicle system.

Based on this, it is an essential core idea of the invention that it is not the excessive but actually transferable maximum frictional force that is reduced, but a suitable reduced virtual frictional adhesion force limit is specified, and that two different operating states can be simulated computationally based on the reduced virtual frictional adhesion force limit: In a normal mode, in which the computationally determined but uncorrected operating frictional force is less than the virtual frictional adhesion force limit, the driving behavior of the toy vehicle is computationally simulated under the local effect of a virtual operating frictional force at the level of the uncorrected operating frictional force. In other words, here the physics of driving with wheels adhering to the ground are represented computationally. Alternatively, in a skidding mode, in which the computationally determined uncorrected operating frictional force is greater than the frictional adhesion force limit, the driving behavior of the toy vehicle is simulated under the local action of a virtual operating frictional force, thus in this case a corrected operating frictional force, at the level of the virtual sliding frictional force. In other words, in this case the physics of driving of the skidding vehicle are represented computationally. As a result, the toy vehicle now no longer immediately and directly follows the control inputs of the driver at the remote-control transmitter, but the control output signals produced by the computational driving simulation for steering, drive power, brakes and/or similar. Depending on the simulation results, these are the vehicle movements in the adhering or skidding state. By suitable selection or adjustment of the virtual frictional adhesion force limit to the size of the vehicle, driving dynamics are set up with which not only the physical dimensions of the vehicle, but also the parameters that significantly influence the physics of driving experience a corresponding reduction. The toy vehicle includes a control unit, a drive with roller elements for transmitting frictional forces to the ground and a steering mechanism. The control unit is configured to carry out the computational driving simulation that was outlined above and generates therefrom control output signals and causes the signals to act on the drive with the roller elements and on the steering mechanism such that the toy vehicle carries out a vehicle movement according to the computational driving simulation under the action of the virtual operating frictional force. Logically, the same applies to the corresponding operating method carried out in the manner described above. Despite a reduction, precise modelling of the driving behavior in the normal mode and in the skidding mode and of the transition region between them is possible, because the actual driving behavior of the toy vehicle is always caused via the roller elements thereof, even in the skidding mode under the conditions of adhesion, and only the visual impression of skidding is imparted. However, the adhesion that is actually always present between the roller elements and the ground enables a precise and controlled movement process.

With a configuration according to an embodiment of the invention, the driver can carry out challenging and realistic driving tasks. The virtual frictional adhesion force limit, which occurs instead of the actually transferable maximum frictional force, contributes not only to a more realistic overall impression of the driving behavior, but considerably reduces the necessary speeds or accelerations for the boundary region between adhesion and skidding. The space necessary for realistically acting driving maneuvers can be reduced to a minimum. Complete vehicle races including drift bends and similar can be staged on the size of a desktop, whereas in doing so the visual impression of high speeds and accelerations is given. However, the actual speeds and accelerations are so low that the driver retains sufficient control.

The above conditions are examples for the case described that a reduction in scale of an original vehicle to a certain size of the toy vehicle has occurred, while at the same time the virtual frictional adhesion force limit has been reduced to a corresponding extent compared to the actually available maximum frictional adhesion force limit, so that the achievable accelerations are reduced at least approximately to the same scale. Logically, the same can of course also apply to limiting the maximum achievable speeds. In fact, however, no scaled relationship between the size of the toy vehicle and the virtual frictional adhesion force limit is necessary within the scope of the invention. First of all, it depends on the virtual frictional adhesion force limit being significantly reduced compared to the actual available frictional adhesion force limit in general, in order to simulate driving in the boundary region between adhesive friction and sliding friction under the circumstances of tight space conditions for small accelerations and cornering speeds. Moreover, it can also be advantageous to make the virtual frictional adhesion force limit variable. This allows driving on different ground with more or less slippery sections to be simulated.

In an advantageous embodiment of the invention, an acceleration in the direction of the longitudinal axis of the vehicle is specified, and a frictional force in the direction of the longitudinal axis of the vehicle is derived therefrom. If the frictional force exceeds the virtual frictional adhesion force limit, the acceleration in the direction of the longitudinal axis of the vehicle is reduced to an acceleration limit that corresponds to the virtual sliding frictional force. In this case, acceleration means any acceleration in the direction of the longitudinal axis of the vehicle, which thus besides a forward-directed increase in the speed also includes a braked deceleration corresponding to a rearward-directed acceleration. In any case, in this way either a forward-directed acceleration with rotating wheels or a braking deceleration with locked wheels is simulated and as a result realistic driving behavior is produced.

Alternatively or additionally, within the scope of the invention it is provided that when driving along a bend with a local radius, an acceleration of the toy vehicle in the direction of the local radius is derived and a frictional force transverse to the direction of the longitudinal axis of the vehicle is derived therefrom. If the frictional force acting transverse to the direction of the longitudinal axis of the vehicle exceeds the virtual frictional adhesion force limit, the control unit acts on the drive and/or on the steering mechanism of the toy vehicle such that the toy vehicle carries out a local component of motion transverse to the longitudinal axis of the vehicle.

The "local" component of motion means that it can indeed apply to the entire vehicle, but does not have to. It can be sufficient if only the front or the rear of the vehicle performs such a lateral component of motion to represent "breakaway".

In the simplest case, the toy vehicle performs a motion that corresponds to sideways skidding without a change in the direction of the longitudinal axis. In an advantageous embodiment, the longitudinal axis of the vehicle is at a first angle to the local tangent of the bend being traversed in the normal mode, wherein the longitudinal axis of the vehicle, starting from the first angle, is then transitioned to a second angle to the local tangent of the bend being traversed in the simulated skidding mode. This allows the driving conditions to be reproduced realistically during understeer, but in particular also during oversteer, that is during so-called "drifting".

For the implementation of the operating method described above, in physical means a suitably configured and programmed control unit on the one hand and a suitable physical configuration of the toy vehicle on the other hand are required. According to the latter aspect, the toy vehicle includes at least two drive motors and at least two roller elements for transferring drive torque to the ground, wherein the roller elements can be mutually independently driven rotationally about respective axes of rotation via the drive motors. The toy vehicle further includes at least one steering mechanism for adjusting directions of orientation of the axes of rotation relative to the longitudinal axis of the vehicle. The control unit configured in particular according to the provisos described above acts on the drive motors and the at least one steering mechanism. This enables the model vehicle to be moved in any direction that differs from the actual orientation of the longitudinal axis thereof. Conversely, the longitudinal axis of the vehicle can be brought into any relative orientation to the current direction of motion, so that on the one hand the normal mode and on the other hand the skidding mode can be implemented conspicuously and realistically without skidding of the roller elements on the surface actually occurring. Within the scope of the invention, it is however not absolutely necessary that the operating method described above or a correspondingly configured control unit is used. Rather, it can also be sufficient in a further aspect of the invention that the control unit is implemented simply and the simulation is wholly or partly omitted as long as the toy vehicle is otherwise physically implemented according to the above description. For example, by a signal output by the user (for example pressing a "drift" knob) or on meeting simple logical conditions (for example IF "vehicle speed≥x" AND "steering angle≥y" THEN . . . ) the toy vehicle can be moved such that the longitudinal axis of the vehicle is not parallel to the local direction of motion. In any case, this also gives the possibility of driving with a realistic impression of a drift motion, even during comparatively slow travel and/or under spatially tight conditions.

For the physical configuration mentioned above, different variants come under consideration. In one advantageous embodiment, two drive units are provided, each with a drive motor, each with a roller element and each with a dedicated steering mechanism, wherein a drive unit is disposed before or after the center of gravity of the toy vehicle in the direction of the longitudinal axis of the vehicle. As a result of the configuration, the vehicle rests on one of the drive units in the front region thereof and in the rear region thereof in each case. The front region and the rear region of the toy vehicle can be displaced mutually independently in more or less pronounced lateral movement, which enables almost any possibilities for the reproduction of the driving behavior in the boundary region between adhesive friction and sliding friction.

In an advantageous embodiment of the implementation mentioned above, the two steering mechanisms each include a bogie with a vertical steering axle and with an associated steering drive, wherein there is a respective drive motor associated with each bogie. At least each roller element is implemented in the form of a drive wheel and is supported with an associated first or second rotation axle on a respective bogie such that the first rotation axle and the second rotation axle are mutually independently displaceable via the two bogies. In particular, each of two drive wheels is disposed at an axial separation from the other on each of the two rotation axles. The arrangement is mechanically simple in configuration and reliable in operation. With a total of three and preferably four drive wheels, the model vehicle in most cases stands level and stable on the drive wheels. Additional supporting measures may be required in the case of strongly deflected drive units, and then only to a slight degree that does not adversely affect the driving behavior.

Alternatively, it can be advantageous that the roller elements are spherical, wherein first and second drive shafts are each disposed with an associated drive motor at a right angle to each other and engage the spherical surface of the roller elements by friction. In this case, the steering mechanism is formed by a coordination unit for a coordinated determination of revolution rates of the first and second drive shafts. The balls enable a direct and temporally delay-free change of orientation of the currently acting rotation axis thereof without a dedicated rotary drive being necessary for this. Transient changes of state can be represented without delay.

In an advantageous alternative, not two, but only exactly one drive unit is provided, which includes two drive motors, two roller elements in the form of wheels and a steering mechanism. The first roller element can be driven about the first rotation axle by the first drive motor. The second roller element is disposed at an axial distance from the first roller element and can be driven about the second rotation axle by the second drive motor, and indeed independently of the first drive motor. The first rotation axle and the second rotation axle can be commonly adjusted by the one steering mechanism. The center point between the two roller elements lies in the region of the center of gravity of the toy vehicle, so that the toy vehicle rests with most of the dead weight thereof on the roller elements of the one drive unit. The mechanically very simple but yet very effective implementation is based on the knowledge that the physics of driving acting in the plane of the ground to be traversed can be reduced to three motion variables, namely to two lateral components of motion in two mutually perpendicular directions and to a rotary motion about a vertical axis. This can also be actually mechanically implemented if the center point between the two roller elements lies in the region of the center of gravity of the toy vehicle. That is, most of the acting mass forces of the two roller elements or the two wheels are then taken up and converted into frictional force. Indeed, the two wheels are not sufficient to fully support the vehicle. Dummy wheels or other parts of the vehicle can however be used for positional stabilization with only small supporting loads without noticeably falsifying the driving conditions predetermined by the drive units because of the small supporting forces and frictional forces thereof.

No particular requirements are placed on the visual configuration of the toy vehicle. Any abstract but also correctly scaled shape can be selected. Nevertheless, it has been shown that the impression of "reduced" physics of driving turns out to be particularly realistic if the toy vehicle reproduces some essential features of people-carrying motor vehicles in the external appearance thereof. This includes above all the wheels of the original motor vehicle, which however cannot be used here for the same function as wheels. In a preferred embodiment, therefore at least one pair of dummy wheels is provided, wherein a pair of dummy wheels is advantageously configured to be steerable or freely deflectable. A "dummy wheel" in this case means an element that does have the visual appearance of a wheel, but does not carry out the function thereof. Such dummy wheels may indeed stand on the ground to be traversed and may also roll on the ground. However, because by far the greatest part of the weight force of the roller elements described further above is absorbed, they act as aids to support if necessary with significantly smaller contact forces, without setting up significant lateral frictional forces in this case. The dummy wheels thus do not determine the movement of the toy vehicle, which is the task of the roller elements mentioned above or the one or two drive units mentioned above. Also, any existing steering movement of the dummy wheels has no direct influence on the direction of travel of the toy vehicle. In other words, the dummy wheels can indeed be brought into a position typical of a vehicle and appear like normal wheels, but have in contrast thereto neither a driving nor a steering function. The small but existing contact forces of the dummy wheels in connection with a pivotal support and a caster can be used such that in the orientation thereof the dummy wheels follow the respective path, that is, they are freely deflectable. In most of the achievable driving states, this enhances the visual impression of a matching reproduction of the driving behavior. Of course, it is also possible to make the dummy wheels steerable and to actuate them actively in the steering movement thereof. If for example during oversteer or understeer the steering direction indicated by the driven dummy wheels does not agree with the actual vehicle movement, the visual impression of lateral skidding is enhanced. The dummy wheels can moreover be configured such that they visually conceal the actually acting drive units and in particular the roller elements thereof that are producing the vehicle movement. This also contributes to a realistic appearance of the vehicle movement.

From the outset, the basic principles of the computational driving simulation in the control unit and the generation of the control output signals derived therefrom have been described in abstract form, which applies to toy vehicles according to the invention of any configuration regardless of the details thereof. But if the toy vehicle is perceived, at least in respect of an original wheeled vehicle, that it includes at least one pair of dummy wheels, then the dummy wheels are also based on the driving simulation. More specifically, the computational driving simulation of the virtual frictional adhesion force limit, the virtual sliding frictional force, the uncorrected operating frictional force and the virtual operating frictional force between the dummy wheels and the ground is based on the assumption that the toy vehicle is rolling on wheels corresponding to the dummy wheels and would be driven by the dummy wheels. Based on the result of the computational driving simulation, there is then a physical vehicle movement that imparts the realistic impression as if the toy vehicle were driving or skidding on the dummy wheels thereof, whereas the actual vehicle movement is not brought about via the dummy wheels, but via the steering mechanism(s) and the drive unit(s), including the mentioned roller elements.

It can be advantageous that the control unit, in which the computational simulation of the physics of driving and the generation of the control output signals occur, is mounted in the toy vehicle or in the receiving unit thereof. However, the control unit is preferably disposed in the remote-control transmitter, so that only the control output signals processed in a manner according to the invention have to be transmitted by the remote-control transmitter to the receiver of the toy vehicle. No particular requirements are placed on the receiving unit of the toy vehicle, so that this can be made very small and also very inexpensive. A conventional remote-control transmitter comes under consideration that is augmented by a suitable control unit or that is reprogrammed in a suitable way. However, the assembly unit of a control unit and a remote-control transmitter is preferably formed by a programmed smartphone or by another mobile terminal such as a tablet or similar. As a general rule, the units have sufficient computational power and moreover suitable radio interfaces, so that suitable hardware is available to a wide public without additional investment. Only suitable programming is necessary.

BRIEF DESCRIPTION OF THE DRAWINGS

The invention will now be described with reference to the drawings wherein:

FIG. 7 shows in a perspective top view a version of the implementation according to FIGS. 5 and 6 with only one central bogie;

FIG. 8 shows in a perspective view from below a further version of the arrangement according to FIGS. 5 and 6 with balls instead of wheels to form the driving roller elements; and FIG. 9 shows in a top view the chassis according to FIG. 8 with details of the interaction of the balls with associated drive shafts.

DESCRIPTION OF THE PREFERRED EMBODIMENTS OF THE INVENTION

Figure 1:
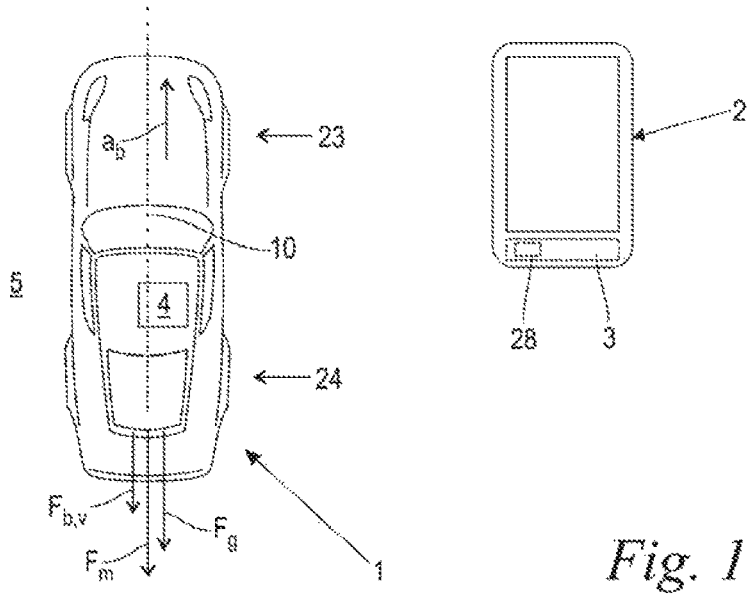
FIG. 1 shows in a schematic top view a toy vehicle system according to the invention with a smartphone as the remote-control transmitter and with a toy vehicle during a longitudinal acceleration.

FIG. 1 shows in a schematic top view an embodiment of the toy vehicle system including a toy vehicle 1 and an associated remote-control transmitter 2. The remote-control transmitter 2 can be a radio remote-control transmitter that is customary in model construction. In the depicted preferred embodiment, a smartphone is selected as the remote-control transmitter 2. As an alternative to the smartphone, a tablet or similar also in the usual configuration comes into consideration.

The toy vehicle 1 is provided with a receiver 4 that receives control output signals of the remote-control transmitter 2. The toy vehicle 1 includes furthermore roller elements 6, 8 driving the toy vehicle 1 and a steering mechanism that are not shown here but that are described in detail further below, and that are actuated or operated via the receiver 4 according to the demands of the remote-control transmitter 2.

In the embodiment depicted, the receiver 4 receives the control output signals of the remote-control transmitter 2 via a radio path lying between them. In this case, this can for example be a Bluetooth connection, wherein however, other transmission protocols and transmission frequencies can also be considered. Other forms of signal transmission, for example via infrared or wired link, can also be implemented within the scope of the invention.

The toy vehicle 1 can include a more or less pronounced similarity to a people-carrying model vehicle, but is reduced in size compared thereto. No particular requirements are placed on the actual size of the toy vehicle 1. For the targeted operation under spatially tight space conditions, however, a maximum vehicle length from one meter down to a few centimeters is desirable and can also be implemented within the scope of the invention. In the case of a reduction in scale of a model vehicle, there are the usual reduction scales of 1:8, 1:10 and 1:12 to 1:24 or still smaller. Regardless of the actual or not yet implemented scale reproduction, advantageously at least one virtual front axle 23 and at least one virtual rear axle 24 are provided with the dummy wheels 21, 22 represented in FIG. 5 ff. The designation selected here of the front and rear axles 23, 24 as "virtual" arises from the following descriptions of embodiments of the invention.

In operation, the toy vehicle 1 travels on ground 5 that is not represented in detail. In the case of uniform straight-ahead travel, no significant horizontal forces act between the toy vehicle 1 and the ground 5 in the plane of the ground 5. The latter changes once accelerations act on the toy vehicle 1 in the plane of the ground 5.

In FIG. 1, primarily by way of example the simple case of an operational acceleration ab forwards in the direction of the longitudinal axis of the vehicle 10 is represented. A partial objective of the configuration according to the invention and of the process flow according to the invention is to give the impression as if the toy vehicle 1 were standing and driving on the dummy wheels 21, 22 of the virtual front and rear axles 23, 24 thereof. To achieve the operational acceleration ab, an opposite driving frictional force would now have to act between the toy vehicle 1 and the ground 5. In the embodiment shown, this means that the dummy wheels 21, 22, if they were driving the toy vehicle 1, would have to exert a frictional force acting on the ground 5 in the opposite direction. With increasing operational acceleration ab, the magnitude of the necessary frictional force also rises. However, if instead of the dummy wheels 21, 22 regular wheels were provided, on which the toy vehicle 1 were standing, and via which the toy vehicle 1 were driven, the actual achievable or transferable maximum frictional force between the drive wheels represented by the dummy wheels 21, 22 and the ground 5 would be so great that without further measures a corresponding uncorrected operating frictional force Fb would result in such a large operational acceleration ab that this would not have a realistically acting relationship to the size of the toy vehicle 1. Therefore, according to an aspect of the invention the maximum frictional force is limited as follows:

The control input signals produced by the user are not directly converted by the remote-control transmitter 2 into control output signals. Rather, a control unit 3 is provided that is integrated within the remote-control transmitter 2 here, and into which the control input signals of the remote-control transmitter 2 produced by the user or by the driver are supplied. Based on this, the control unit 3 generates control output signals modified according to the provisos described below, which then act on the drive and on the steering mechanism of the toy vehicle 1. A control unit 3 is used for this that is configured and programmed for a certain computational driving simulation that is described below.

Figure 2:
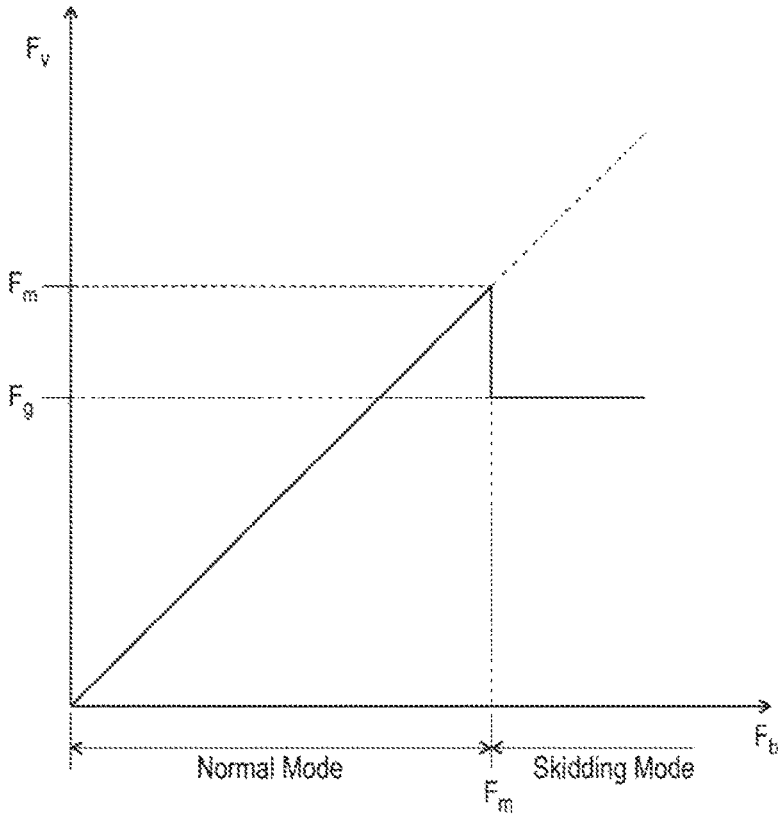
FIG. 2 shows in a schematic diagrammatic representation the relationships between an uncorrected operating frictional force and a corrected virtual operating frictional force as the basis for the actuation according to the invention of the toy vehicle.
Figure 5:
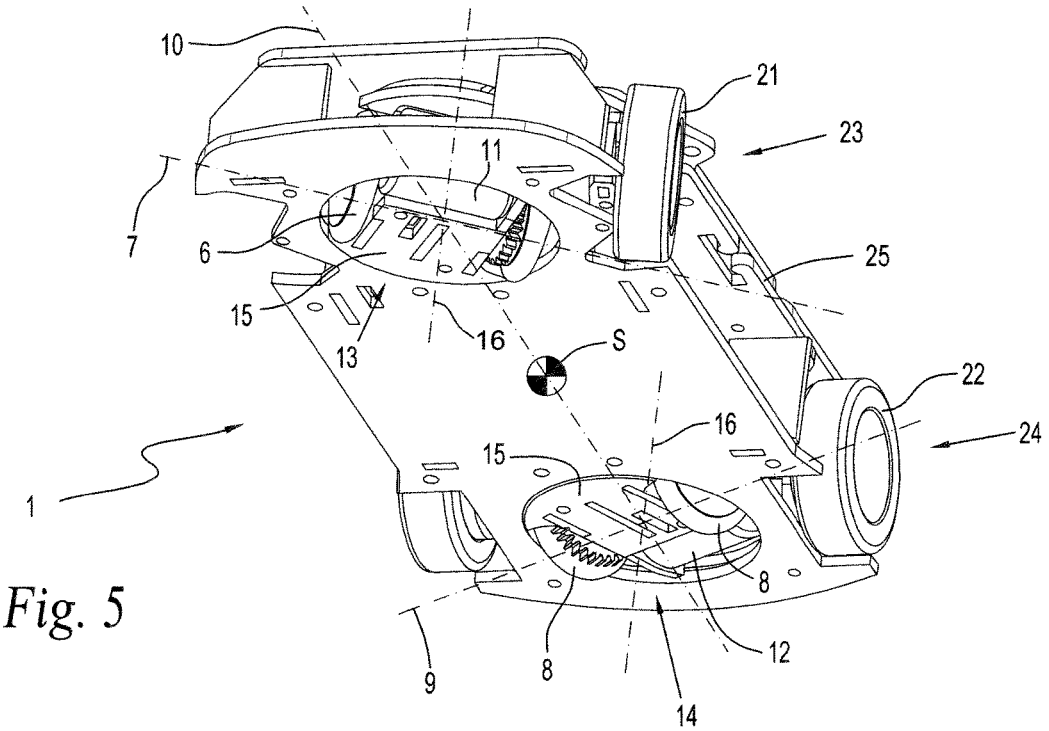
FIG. 5 shows in a perspective view from below a first embodiment of a drive arrangement for a toy vehicle according to FIGS. 1 through 4 with two bogies, each of which is fitted with two drive wheels, and with three of a total of four dummy wheels.

The driving behavior influenced according to an aspect of the invention is based on a limitation of the maximum achievable operational acceleration $a_b$ via substitution for the uncorrected operating frictional force $F_b$ of a corrected, virtual operating frictional force $F_v$, as schematically represented in the diagram according to FIG. 2. For this purpose, a virtual adhesive force limit $F_m$ is defined that is less than the maximum frictional force that can actually be transferred to the ground 5 via the drive elements 6, 8 (FIG. 5 ff.). Moreover, a virtual sliding frictional force $F_g$ is defined that for its part is ≤the virtual frictional adhesion force limit $F_m$. All the forces are shown schematically in FIG. 1 and can be called up as fixedly specified or variable parameters in the control unit 3. The virtual adhesive force limit $F_m$ and the virtual sliding frictional force $F_g$ can optionally be dimensioned such that the resulting operational accelerations $a_b$ are reduced in magnitude at least approximately to the same scale relative to an original as the toy vehicle 1 itself, wherein as reference variables for the reduction such an actual adhesive force limit, such an actual sliding frictional force and such an actual operational acceleration $a_b$ of the original can be used as a basis, as they are known or expected from the interaction between the original tires and the original ground.

The principle in one aspect of the invention is clear in the simple example of the acceleration according to the overall view of FIGS. 1 and 2: The driver demands "gas" via the remote-control transmitter 2, that is, generates the control signal for the acceleration. Based on this, in the control unit 3 a computational driving simulation is carried out, within which the operational frictional forces $F_b$ acting between the toy vehicle 1 and the ground 5 and initially still uncorrected are determined computationally and compared with the virtual frictional adhesion force limit $F_m$. More accurately speaking, the uncorrected operational frictional forces $F_b$ acting between the actually non-existent but assumed virtual wheels of the virtual front and rear axles 23, 24 and the ground 5 are used as the basis of the computational simulation. The dummy wheels 21, 22 (FIGS. 5 through 9) represent the virtual wheels only visually, but do not carry out the physical driving function thereof.

Provided that the driver only demands a moderate acceleration, in the case of which the uncorrected operating frictional force $F_b$ is less than the virtual adhesive force limit $F_m$, the law of adhesion between the wheels and the ground 5 applies, which is referred to here as the normal mode. In the computational driving simulation, a virtual operating frictional force $F_v$ is determined as one of the output variables. In the normal mode, the virtual operating frictional force $F_v$ is set to be the same in magnitude and direction as the uncorrected operating frictional force $F_b$. The driving behavior of the toy vehicle 1 under the local action of the operating frictional force $F_b$ is consequently computationally simulated in the control unit 3 according to an adhesive frictional force.

If, however, the driver demands too much "gas", provided that the associated uncorrected operating frictional force $F_b$ determined in this case in the computational driving simulation is greater than the previously specified virtual frictional adhesion force limit $F_m$, driving behavior is to be set up as for spinning wheels. This is referred to here as skidding mode, in which the virtual sliding frictional force $F_g$ is acting. The virtual operating frictional force $F_v$ is set in magnitude and direction the same as the virtual sliding frictional force $F_g$ in this case and is used as the basis for the computational driving simulation. The toy vehicle 1 thus moves in the computational simulation as if the wheels were spinning under the action of the virtual sliding frictional force $F_g$.

In both cases of the normal mode or of the skidding mode, based on the respective computationally determined virtual operational frictional forces $F_v$, corresponding control output signals are generated such that the toy vehicle 1 performs a vehicle movement according to the computational driving simulation. In the case of the example according to FIG. 1, this means that the toy vehicle 1 performs an acceleration $a_b$ in the normal mode based on the uncorrected operating frictional force $F_b$. If, however, the driver demands too much acceleration, which leads to a driving simulation in the skidding mode, the uncorrected operating frictional force $F_b$ is set in magnitude and direction to the virtual sliding frictional force $F_g$, which results in a correspondingly limited forward acceleration. Analogously, the same also applies to rearward directed accelerations corresponding to a braking maneuver, wherein in the normal mode the laws of adhesion apply, and wherein as a result of excessive brake operation locking of the wheels is simulated by basing the deceleration on the virtual sliding frictional force $F_g$. Of course, according to the procedure described above, the hysteresis that results from the virtual sliding frictional force $F_g$ that is smaller compared to the virtual adhesive force limit $F_m$ is taken into account and reproduced: the virtual operating frictional force $F_v$ is only again set equal to the uncorrected operating frictional force $F_b$ if the driver returns the acceleration a and hence the uncorrected operating frictional force $F_b$ to a level below the virtual sliding frictional force $F_g$. In the event of an increase in the acceleration a, reaching the virtual adhesive force limit $F_m$ acts as a changeover signal from the normal mode to the skidding mode, whereas in the event of the acceleration a reducing, reaching the virtual sliding frictional force $F_g$ acts as a changeover signal from the skidding mode into the normal mode.

Figure 3:
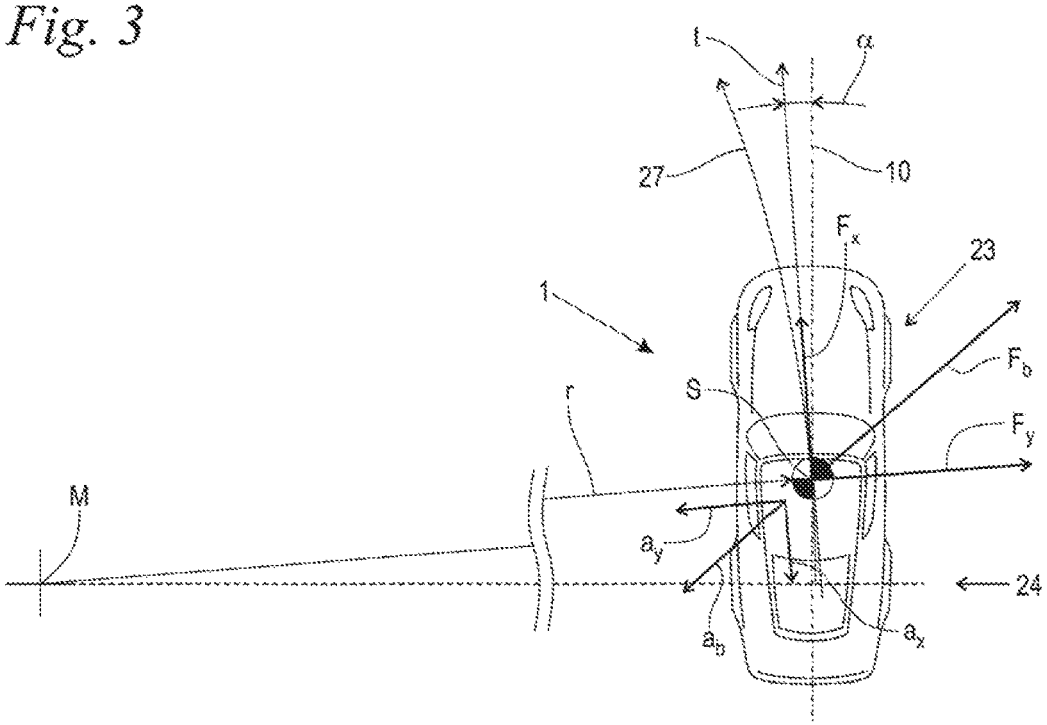
FIG. 3 shows the toy vehicle according to FIG. 1 when cornering in the normal mode.

The simulation conditions for the simple case of a longitudinal acceleration are described above. In addition to this, FIG. 3 shows the toy vehicle 1 according to FIG. 1 when traversing a bend. The toy vehicle 1 is moving with a certain forward speed along a bend 27 that is being traversed with a local bend radius r about an associated local center point M. For the determination of the local movement and force conditions, an arbitrary reference point on the toy vehicle 1 can be selected. In the embodiment shown, the center of gravity S of the toy vehicle 1 is selected as the reference point. The center of gravity S is moving in the direction of a tangent t to the bend 27 being traversed at a certain speed. A centripetal acceleration $a_y$ directed towards the center point M and an associated lateral force $F_y$ directed radially outwards result from the speed and the local bend radius r. Both can be determined within the scope of the computational driving simulation carried out via the control unit 3. In addition, thus at the same time a longitudinal acceleration $a_x$ can be carried out that is directed rearwards here by way of example and thus corresponds to a braking maneuver. An oppositely directed longitudinal force $F_x$ corresponds to this, wherein the longitudinal acceleration $a_x$ and the longitudinal force $F_x$ are determined analogously to the procedure according to FIG. 1. The longitudinal and lateral accelerations $a_x$, $a_y$ can be combined vectorially to form an uncorrected operational acceleration $a_b$. The same also applies to a vectorial addition of the longitudinal force $F_x$ and the lateral force $F_y$ to form the uncorrected operating frictional force $F_b$. The same condition again applies to the uncorrected operating frictional force $F_b$ as for the uncorrected operating frictional force $F_b$ acting in the longitudinal direction according to FIGS. 1, 2: here too there is a difference between a normal mode and a skidding mode in the computational driving simulation, wherein however, in the skidding mode lateral skidding is also taken into account. In any case, control output signals are generated via the control unit 3 from the computational driving simulation and are fed to the drive and the steering mechanism of the toy vehicle 1 so that the toy vehicle 1 performs a vehicle movement according to the computational driving simulation.

In FIG. 3, it can still be seen that the longitudinal axis 10 of the toy vehicle 1 lies at a first angle α to the local tangent t of the bend 27 being traversed in the normal mode represented here. The first angle α can be determined for any arbitrary reference point of the toy vehicle 1. The center of gravity S of the toy vehicle 1 is selected here as the reference point by way of example. The angle α depends on the steering geometry of the virtual front axle 23 and the virtual rear axle 24 that is used as a basis. In the embodiment shown, it is assumed that the virtual front axle 23 is steerable, whereas the virtual rear axle 24 maintains the orientation thereof relative to the toy vehicle 1. The result of this is that on the unsteered virtual rear axle 24 the first angle α between the longitudinal axis of the vehicle 10 and the tangent t has the magnitude zero and rises with increasing forward distance from the virtual rear axle 24. In the region of the virtual front axle 23, the first angle α assumes its maximum. Of course, the conditions reverse if a steerable virtual rear axle 24 is used as the basis for the driving simulation. In any case, for a certain reference point, here the center of gravity S, such a first angle α can be determined for the normal mode represented here.

If the driver now preselects too high a speed in the bend and/or too small a local bend radius r, the computationally determined uncorrected operating frictional force $F_b$ exceeds the virtual frictional adhesion force limit $F_m$ (FIG. 2), so that the skidding mode comes into play in the computational driving simulation. The virtual sliding frictional force $F_g$ (FIG. 2) is now used as the virtual operating frictional force $F_v$, wherein however a lateral force direction component also comes into play. The vehicle can now be displaced laterally or transversely relative to the tangent t. For example, the radius r can increase up to ∞, which corresponds to so-called understeer.

Figure 4:
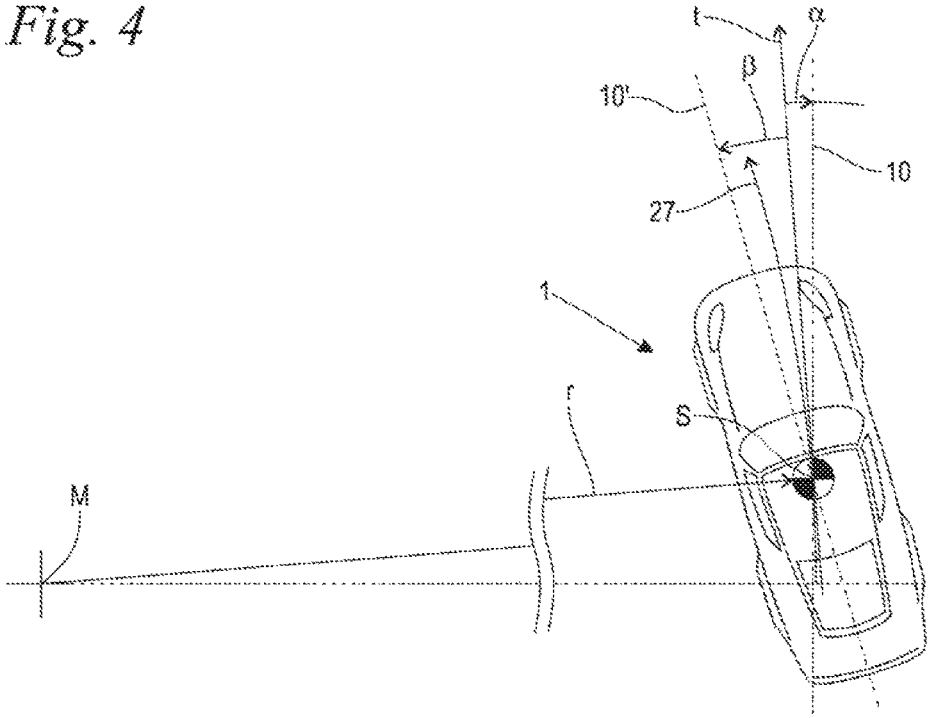
FIG. 4 shows the toy vehicle according to FIGS. 1 and 2 in the skidding mode during oversteer.

Extending beyond a purely lateral vehicle displacement while maintaining the first angle α, in the simulated skidding mode the longitudinal axis of the vehicle 10 can be transferred starting from the first angle α thereof to a second angle β to the local tangent t to the bend 27 being traversed. Such a case is represented by way of example in FIG. 4. Starting from the first angle α as a reference variable, the positionally changed longitudinal axis of the vehicle 10' is inclined to the inside of the bend by the second angle β, which corresponds to so-called oversteer or drift. The case can also be represented via the control unit 3 in the computational driving simulation during skidding mode and can be implemented in corresponding control output signals, wherein the toy vehicle 1 carries out actual corresponding cornering while reproducing the oversteer or understeer according to FIGS. 3 and 4. Here too, the speeds and accelerations are however limited to such an extent that actually no skidding between the roller elements 6, 8 (FIG. 5 ff.) of the toy vehicle 1 and the ground 5 takes place. Rather, the toy vehicle 1 carries out a vehicle movement specified by the control unit 3 that gives a realistic impression as if the toy vehicle 1 were rolling or skidding on the wheels thereof during understeer or oversteer, when braking and/or during acceleration.

In connection with FIGS. 1 through 4, static states of laterally acting accelerations are represented. Nevertheless, the computational simulation and the driving movement of the toy vehicle 1 derived therefrom can also include angular accelerations about the vertical axis and transient transitions between different driving states. Starting from the minimal prerequisites described above, the difference between the normal mode and the skidding mode can arbitrarily refine the computational driving simulation and be converted into a corresponding driving movement of the toy vehicle 1. This also includes, besides the described limiting of the possible accelerations, limiting the possible speeds. The difference between adhesive friction and skidding friction, that is, between normal mode and skidding mode, can be carried out individually for each dummy wheel 21, 22, in order for example to take into account varying distributions of the individual wheel loadings for specific situations. However, simplifications also come into consideration, for which the distinctions are only made for each virtual front or rear axle 23, 24 or for the toy vehicle 1 in the respective totality thereof. In the absence of dummy wheels 21, 22, virtual reference points can also be selected as a replacement. Moreover, the same simulation principle can also be transferred to vehicles without wheels in an analogous manner.

An interesting aspect is for example that the virtual adhesive force limit $F_m$ effectively acting as a changeover signal between the two operating modes does not have to be set to a certain magnitude. It can for example be different depending on the direction, therefore different limit values can be fixed for a forward acceleration, a braking maneuver and/or laterally acting centripetal accelerations. Moreover, the virtual adhesion force limits $F_m$ can be varied during operation. This enables for example a progressive coefficient of friction-increasing wear or travelling on different ground with different adhesion properties to be simulated. The toy vehicle 1 can for example be provided with a detector that is not represented and that detects a section of the road to be considered as particularly slippery, and that as a result thereof causes a reduction of the otherwise already reduced virtual adhesive force limit $F_m$. In a further aspect of the invention, the changeover between the two operating modes does not have to be carried out based on the computational driving simulation described above. Rather, it can be sufficient to carry out the changeover for example automatically based on meeting simple logical conditions (IF-THEN conditions) or based on a signal specified by the user (operating a control function), wherein any combination of computational simulations, logic functions and/or user signals can be considered. In the extreme case, it can suffice within the scope of the invention to bring the longitudinal axis of the vehicle out of parallelism with the local direction of motion and as a result to impart the impression of drift motion, in particular when cornering.

FIG. 5 shows in a perspective view from below a first embodiment of the toy vehicle 1 according to FIGS. 1 through 4 with the body removed. A chassis 25 supports two drive units 13, 14 on the underside thereof facing the ground 5 (FIG. 1) during operation. The one drive unit 13 is positioned before the center of gravity S of the toy vehicle 1 in the direction of the longitudinal axis of the vehicle 10, whereas the second drive unit 14 lies behind this. The front drive unit 13 includes a pair of roller elements 6 that can be driven rotationally and coaxially to each other about a common rotation axis 7. The two roller elements 6 are implemented here as friction wheels and are configured for a frictional drive of the toy vehicle 1 relative to the ground 5 (FIG. 1). A drive motor 11 acting commonly on both roller elements 6 is provided for this purpose. Logically, the same also applies to the identically configured rear drive unit 14 with a pair of roller elements 8 implemented as friction wheels, with an associated rotation axis 9 and with an associated drive motor 12.

Figure 6:
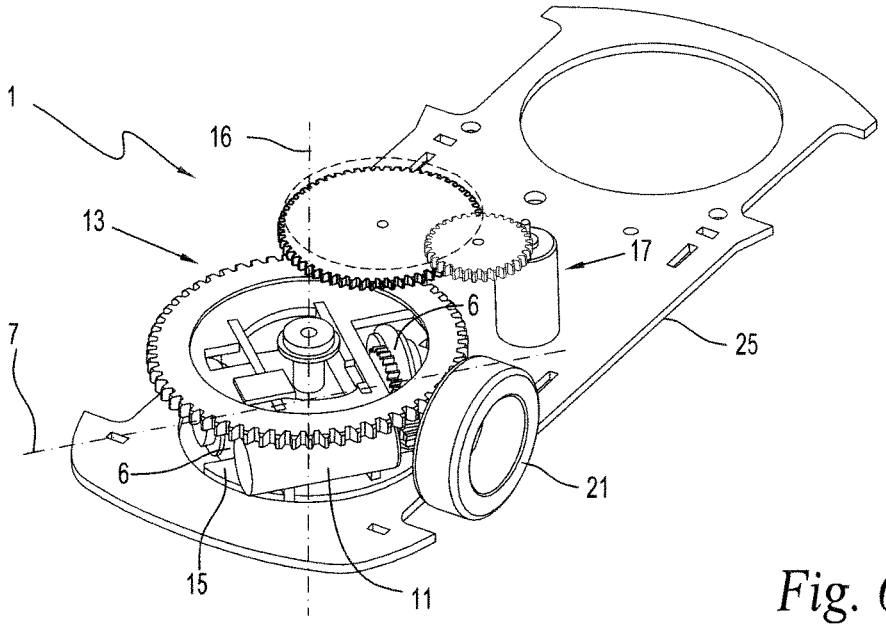
FIG. 6 shows in a perspective top view a part of the arrangement according to FIG. 5 with details of the configuration of the bogie.

Both drive units 13, 14 are each provided with a dedicated and mutually independently actuated steering mechanism, via which the directions of orientation of the axes of rotation 7, 9 about a respective vertical steering axis 16 can be adjusted relative to the longitudinal axis 10 of the vehicle. Details of the steering mechanism are revealed by the overall view of FIGS. 5 and 6, wherein FIG. 6 shows in a perspective top view a part of the arrangement according to FIG. 5 with the rear drive unit 14 omitted. From the overall view of the two FIGS. 5 and 6, it can be seen that the two steering mechanisms each include a bogie 15 with a vertical steering axis 16 and with a respective associated steering drive 17. For simplicity, only the front drive unit 13 and the front bogie 15 are referred to below, wherein however the same also applies analogously to the rear drive unit 14 with the rear bogie 15. The two roller elements 6 with the horizontal rotation axis 7 thereof are supported on the bogie 15. In the embodiment shown, the associated drive motor 11 is also mounted on the bogie 15. During a steering movement about the vertical steering axis 16, the entire bogie 15 turns including the two roller elements 6, the rotation axis 7 thereof and of the drive motor 11. It can however also be advantageous to mount the drive motor 11 fixedly, that is, non-rotationally, on the chassis 25, wherein the motor then acts on the roller elements 6 via suitable gear assemblies or other means of transmission. The steering drive 17 is fixedly mounted on the chassis 25 and acts on the bogie 15 via gear wheels such that it carries out a steering pivoting movement about the vertical or steering axis 16. Here too, a reverse implementation is possible, in which the steering drive 17 is mounted on the bogie 15 and turns together with the bogie. The rear drive unit 14 with the bogie 15 that is constructed similarly, in this case even in a mechanically identical way, can be driven and steered independently of the front drive unit 13 with the bogie 15.

Referring again to FIG. 5, it should be noted that the chassis 25 supports a pair of dummy wheels 21, 22 in each case in the region of the virtual front axle 23 and also in the region of the virtual rear axle 24. The two dummy wheels 22 of the virtual rear axle 24, each disposed on both sides in relation to the longitudinal axis 10, have a fixed orientation relative to the chassis 25 and are also not steerable. The two dummy wheels 21 attached to the chassis 25 in an analogous manner in the region of the virtual front axle 23 are by contrast implemented to be freely deflectable, wherein for an improved overview only one individual dummy wheel 21 with a steering angle is represented here. For this purpose, a pivotal support with caster is provided for the front dummy wheels 21. The front dummy wheels 21 thus automatically orient themselves in the respective direction of travel. Alternatively, active steering of the front dummy wheels 21 with dedicated steering drives can also be considered. Of course, a steering movement can also be omitted for simplification.

In contrast to the roller elements 6, 8 responsible for the drive and also for the steering of the toy vehicle 1, the dummy wheels 21, 22 are dummies insofar as they do have the external appearance of wheels, but not the function thereof of tracking and/or of exerting drive. They are supported flexibly and/or upright on the chassis 25 relative to the roller elements 6, 8 such that either they do not contact the ground during operation, or if necessary only contact the ground 5 (FIG. 1) with small contact forces. Quite the opposite, the toy vehicle 1 stands on the ground 5, owing to the center of gravity S thereof lying between the two drive units 13, 14 thereof during operation with the roller elements 6, 8, such that by far the greatest part of the acting weight force of the roller elements 6, 8 is supported. In combination with the drive motors 11, 12, drives are also formed, via which the roller elements 6, 8 transfer frictional forces to the ground 5 such that the toy vehicle 1 is driven. For very large transferable frictional forces, the roller elements 6, 8 are provided with a coefficient of friction-increasing tire, for example of rubber or comparable elastomeric material. Conversely, it can be advantageous that the dummy wheels 21, 22 are manufactured from materials with low coefficients of friction such as hard plastic or similar, in order to generate very low frictional forces in the case of contact with the ground, whereby errors produced in the drive effect and steering effect that are produced by the drive units 13, 14 by contact of the dummy wheels 21, 22 with the ground are reduced to a minimum or even completely eliminated.

A special feature is that that the axial distance between the two roller elements 6 on the front rotation axis 7 and also the axial distance between the two roller elements 8 on the rear rotation axis 9 is optionally significantly less than the width of the chassis 25. As a result, it is achieved that the roller elements 6, 8 and the position of the axes of rotation 7, 9 thereof during operation are practically not visible or at most are visible to a restricted extent. The effect can also be increased by disposing each of the two drive units 13, 14 between a pair of dummy wheels 21, 22.

From the overall view of FIGS. 1 through 6, it is now clear that any driving movements of the toy vehicle 1 according to FIGS. 1 through 4, including skidding movements that are simulated or initiated in another way, can be achieved by coordinated actuation of the two drive units 13, 14 and the corresponding steering mechanism. In other words, arbitrary vehicle movements of the toy vehicle 1 according to FIGS. 1 through 4 can be carried out, wherein the vehicle movements are actually carried out by more or less slip-free rolling of the roller elements 6, 8 on the ground, while at the same time the visual impression of a skidding movement can be produced. The toy vehicle 1 can be oriented and moved at any arbitrary angle $\alpha$, $\beta$ to the tangent t to a bend 27 being traversed, which also includes bends 27 with a radius $r=\infty$, that is, straight-ahead travel according to FIG. 1. For the virtual front axle 23 and the virtual rear axle 24, the angles $\alpha$, $\beta$ can be determined mutually independently. If the drive units 13, 14 as in FIGS. 5, 6 are each positioned more or less exactly on the virtual front axle 23 or the virtual rear axle 24, the axes of rotation 7, 9 thereof are pivoted by the respective angle $\alpha$, $\beta$. In connection with a suitable revolution rate of the roller elements 6, 8, the toy vehicle 1 then carries out a vehicle movement according to the computational driving simulation described above, as also shown in FIGS. 1 through 4. If the drive unit 13 and/or the drive unit 14 is not accurately positioned on the virtual front axle 23 or the virtual rear axle 24, a computational correction of the angular position of the drive units 13, 14 can be carried out such that as a result the virtual front axle 23 and also the virtual rear axle 24 carry out movements in the respective associated angles $\alpha$, $\beta$ thereof. In any case, the vehicle movements are essentially exclusively caused by the two drive units 13, 14 with the associated steering mechanism under the action of adhesion between the roller elements 6, 8 and the ground 5, without the dummy wheels 21, 22 playing a significant role during this. Therefore, the front and rear axles 23, 24 are also referred to here as "virtual", because they have no significant influence on the actual driving process. Nevertheless, the positions of the virtual front and rear axles 23, 24 and the dummy wheels 21, 22 thereof relative to the tangent to the bend t play a particular role in the visual appearance: if the orientation of the dummy wheels 21, 22, and in particular the steering angle of the steered front dummy wheels 21, is not coaxial with the actual vehicle movement, there is the impression of a laterally side slipping toy vehicle 1 in a particularly pronounced manner, although actually there is permanently a non-skidding traction drive via the roller elements 6, 8, which are hardly detectable or are not at all detectable.

Further above, it has already been noted that the virtual adhesive force limit $F_m$ should be smaller than the actual maximum frictional force that can be transferred to the ground 5 via the drive elements 6, 8. A more accurate rendering of the requirement arises from the above descriptions: The virtual adhesive force limit $F_m$ should be less than the frictional force between the drive elements 6, 8 and the ground 5 that is necessary for the reproduction thereof in the traction drive. This ensures that both the normal mode and the skidding mode can be represented via the drive elements 6, 8 in the pure adhesion mode.

FIG. 7 shows in a perspective top view a version of the implementation according to FIGS. 5 and 6 with only a single central bogie 15. The steering drive 17 that is certainly present (FIG. 6) is not represented here for a better overview. However, the steering mechanism corresponds in configuration and function to the configuration as described in connection with FIGS. 5 and 6. The drive concept is in contrast to this, however: a pair of commonly driven roller elements is not mounted on the bogie 15. Rather, there are a first roller element 6 and a second roller element 8 that are each mutually independently driven by a respective associated drive motor 11, 12. The drive motors 11, 12 that are only schematically represented here are attached to the chassis 25 according to a preferred embodiment, but can also be disposed on the bogie 15 as in the embodiment according to FIGS. 5 and 6. In any case, the two roller elements 6, 8 are configured in the form of wheels, wherein the two associated axes of rotation 7, 9 thereof are at least axially parallel, in the embodiment shown they even lie coaxial to each other. Moreover, they are at an axial distance from each other in relation to the axes of rotation 7, 9. The bogie 15 is positioned on the chassis 25 such that the center of gravity S of the toy vehicle 1 lies on the axes of rotation 7, 9 centrally between the two roller elements 6, 8 as accurately as possible. Conversely, this means that the center point between the two roller elements 6, 8 lies as close as possible to the center of gravity S of the toy vehicle 1.

As also in the case of the embodiment according to FIGS. 5 and 6, it applies here that the acting weight force is almost completely supported by the roller elements 6, 8. The dummy wheels 21, 22 hold the toy vehicle 1 supported in the setpoint horizontal position, for which however only negligibly small contact forces are necessary. Here too it applies that by the common adjustment of the orientation of the axes of rotation 7, 9 about the vertical steering axis 16 in combination with a mutually independent drive of the two roller elements 6, 8, arbitrary vehicle movements according to FIGS. 1 through 4 can be caused, and this is independent of the orientation or steering angle of the dummy wheels 21, 22.

Finally, FIGS. 8 and 9 show yet another version of the arrangement according to FIGS. 5 and 6 with two drive units 13, 14. Each drive unit 13, 14 carries only a single associated roller element 6, 8, which is configured not as a pair of wheels but as a ball. In the perspective view from below according to FIG. 8, it can be seen that the roller elements 6, 8 configured as balls protrude downwards from the chassis 25 and in doing so perform the function of the roller elements 6, 8 according to FIGS. 5 and 6.

Details of the configuration according to FIG. 8 can be seen in the top view according to FIG. 9. Each drive unit 13, 14 includes at least one first drive shaft 18 and at least one second drive shaft 19 positioned orthogonally thereto and associated drive motors 11, 12. In the preferred embodiment shown, a pair of first and second drive shafts 18, 19 is provided for each drive unit 13, 14, which engage the spherical surface 20 of the roller elements 6, 8 frictionally in pairs in opposition. By means of this it is achieved that the spherical roller elements 6, 8 lying between them are fixed both in the longitudinal direction and in the lateral direction, and in the case of corresponding loadings always experience a sufficient drive torque through the drive shafts 18, 19. In addition, a hold-down clamp 26 is disposed above each spherical roller element 6, 8, which counteracts the contact forces acting in operation.

Unlike the embodiment according to FIGS. 5 and 6, no steering drive 17 is necessary in the implementation shown according to FIGS. 8 and 9. Instead of the steering drive 17, here there is a coordination unit 28 schematically indicated in FIG. 1 for coordinated determination of the revolution rate of the first and second drive shafts 18, 19. The coordination unit 28 is disposed in the remote-control transmitter 2 according to FIG. 1 and can be part of the control unit 3 described in detail above. Alternatively, a separate coordination unit 28 can also be provided in the toy vehicle 1 and can be integrated there for example in the receiver 4 or in the drive units 13, 14. In any case, by coordinated determination of the revolution rates of the first and second drive shafts 18, 19 in both drive units 13, 14, the position of the axes of rotation 7, 9 can be mutually independently adjusted and varied relative to the toy vehicle 1, so that drive movements and steering movements occur analogously to the embodiment according to FIGS. 5 and 6. For the mutually independent orientation of the axes of rotation 7, 9, at least two mutually independently operated or actuated drive motors 12 are necessary, which cause a lateral component of rotary motion of the spherical roller elements 6, 8 via the drive shafts 19 lying parallel to the longitudinal axis of the vehicle 10. Unlike this case, however, the proportionate revolution rates of the spherical roller elements 6, 8 should be in the direction of the longitudinal axis of the vehicle 10 and consequently the revolution rates of the drive shafts 18 lying transversely thereto for both drive units 13, 14 are also equal, because the distance from each other of the drive units 13, 14 fixedly mounted on the toy vehicle 1 does not change. Therefore, despite independent drive movements and steering movements, it can be sufficient to only provide a single common drive motor 11 for the drive shafts 18 of both drive units 13, 14 lying transversely to the longitudinal axis of the vehicle 10. In any case, by coordinated revolution rate control of the drive motors 11, 12, and consequently also the drive shafts 18, 19, the orientation of the axes of rotation 7, 9 of both roller elements 6, 8 can be mutually independently adjusted and varied. The same also applies to the resulting revolution rate of the roller elements 6, 8 about the rotation axis 7, 9, as a result of which the same applies to the driving dynamics as for the embodiment according to FIGS. 5 and 6.

Unless expressly described otherwise, the embodiments according to FIG. 7 and according to FIGS. 8 and 9 agree with each other in the other features, reference characters and properties and with the embodiment according to FIGS. 5 and 6.

It is understood that the foregoing description is that of the preferred embodiments of the invention and that various changes and modifications may be made thereto without departing from the spirit and scope of the invention as defined in the appended claims.

What is claimed is:

1. A toy vehicle system comprising:

a toy vehicle defining a longitudinal vehicle axis;

a remote control transmitter;

said toy vehicle having a drive including at least a first drive motor and a second drive motor;

said toy vehicle further having at least a first roller element and a second roller element configured to transfer frictional forces and drive torque to a ground;

said first roller element defining a first rotational axis;

said second roller element defining a second rotational axis;

said first and second roller elements being configured to be independently driven about respective ones of said first rotational axis and said second rotational axis;

at least one steering device configured to adjust an orientation direction of said first rotational axis and said second rotational axis relative to said longitudinal vehicle axis;

a control unit configured to receive control input signals from said remote control transmitter and to generate control output signals configured to act on said first drive motor, said second drive motor and said at least one steering device;

said control unit being configured to call up a virtual adhesive force limit $F_m$ as well as a virtual sliding frictional force $F_g$ between said toy vehicle and the ground;

said virtual adhesive force limit $F_m$ being smaller than a corresponding actually transferable maximum frictional force between said first roller element and said second roller element and the ground;

wherein said virtual sliding frictional force $F_g \leq$ said virtual adhesive force limit $F_m$;

said control unit being configured for a computational driving simulation with incorporation of said control input signals of said remote control transmitter such that:

said control unit computationally determines an uncorrected operational frictional force $F_b$ acting between said toy vehicle and the ground, and compares said uncorrected operational frictional force $F_b$ to said virtual adhesive force limit $F_m$;

wherein, in a normal mode, in which said computationally determined uncorrected operational frictional force $F_b$ is less than said virtual adhesive force limit $F_m$, a driving behavior of said toy vehicle is computationally simulated under local action of a virtual operational frictional force $F_v$ at the level of said uncorrected operational frictional force $F_b$;

wherein, in a skidding mode, in which said computationally determined uncorrected operational frictional force $F_b$ is greater than said virtual adhesive force limit $F_m$, the driving behavior of said toy vehicle is simulated under local action of a virtual operational frictional force $F_v$ at the level of said virtual sliding frictional force $F_g$; and, said control unit being further configured to, from said computational driving simulation, generate control signals and have them act on said drive with said first roller element and said second roller element as well as said at least one steering device such that said toy vehicle performs a driving motion according to said computational driving simulation under action of said virtual operational frictional force $F_v$.

2. The toy vehicle system of claim 1, wherein:

said drive includes a first drive unit and a second drive unit;

said at least one steering device includes a first steering device and a second steering device;

said first drive unit includes said first drive motor, said first roller element and said first steering device;

said second drive unit includes said second drive motor, said second roller element and said second steering device;

said toy vehicle defines a center of gravity S;

one of said first drive unit and said second drive unit is arranged ahead of said center of gravity S with respect to said longitudinal vehicle axis and the other one of said first drive unit and said second drive unit is arranged behind said center of gravity S with respect to said longitudinal vehicle axis.

3. The toy vehicle system of claim 2, wherein:

said first steering device includes a first bogie and defines a first vertical steering axis;

said second steering device includes a second bogie and defines a second vertical steering axis;

said first drive motor is assigned to said first bogie;

said second drive motor is assigned to said second bogie;

said first roller element is a first drive wheel;

said second roller element is a second drive wheel; and, said first roller element and said second roller element are mounted on corresponding ones of said first bogie and said second bogie such that said first rotational axis and said second rotational axis are adjustable independently of each other via said first bogie and said second bogie.

4. The toy vehicle system of claim 3 further comprising:

a third roller element arranged on said first rotational axis at a first axial distance to said first roller element; and, a fourth roller element arranged on said second rotational axis at a second axial distance to said second roller element.

5. The toy vehicle system of claim 2 further comprising:

a first drive shaft assigned to said first drive motor;

a second drive shaft assigned to said second drive motor;

said first roller element and said second roller element each being spherical and having a corresponding spherical surface;

said first drive shaft and said second drive shaft being arranged perpendicular to each other and configured to engage on said spherical surface of corresponding ones of said first roller element and said second roller element in a friction locking manner;

a coordination unit configured to coordinate rotational speed tuning of said first drive shaft and said second drive shaft; and, said coordination unit forming said first steering device and said second steering device.

6. The toy vehicle system of claim 5, wherein said first drive shaft and said second drive shaft engage on said spherical surface of said first roller element and said second roller element frictionally in pairs in opposition.

7. The toy vehicle system of claim 5, wherein said coordination unit is part of said control unit.

8. The toy vehicle system of claim 1, wherein:

said drive is the only drive;

said drive includes said first drive motor, said second drive motor, said first roller element, said second roller element, and said steering device;

said first roller element and said second roller element are wheels;

said first drive motor is configured to drive said first roller element about said first rotational axis;

said second drive motor is configured to drive said second roller element about said second rotational axis;

said second roller element is arranged at an axial distance to said first roller element;

said first rotational axis and said second rotational axis are adjustable via said steering device;

said toy vehicle defines a center of gravity;

said first roller element and said second roller element define a center point therebetween; and, said center point is disposed in the region of said center of gravity.

9. The toy vehicle system of claim 8, wherein:

said steering device includes a bogie having a vertical steering axis and a steering drive;

said first drive motor and said second drive motor are assigned to said bogie; and, said first roller element and said second roller element are mounted on said bogie in such a manner that said first rotational axis and said second rotational axis are disposed coaxially to each other and are conjointly adjustable via said bogie.

10. The toy vehicle system of claim 1, wherein said toy vehicle includes at least a pair of dummy wheels.

11. The toy vehicle system of claim 10, wherein said pair of dummy wheels are configured to be steerable.

12. The toy vehicle system of claim 10, wherein said pair of dummy wheels are configured to be freely deflectable.

13. The toy vehicle system of claim 10, wherein said virtual adhesive frictional force limit $F_m$, said virtual sliding frictional force $F_g$, said uncorrected operating frictional force $F_b$ and said virtual operational operating frictional force $F_v$ between said dummy wheels and the ground are a basis of said computational driving simulation.

14. The toy vehicle system of claim 1, wherein said control unit is configured to act on at least one of said drive and said steering device such that said toy vehicle performs a local component of motion transverse to said longitudinal vehicle axis.

15. The toy vehicle system of claim 14, wherein said control unit is configured to act on at least one of said drive and said steering device during a drive along a curve such that said toy vehicle performs a local component of motion transverse to said longitudinal vehicle axis.

16. The toy vehicle system of claim 1, wherein:

said toy vehicle has at least two dummy wheels;

said virtual adhesive frictional limit force $F_m$, said virtual sliding frictional force $F_g$, said uncorrected operating frictional force $F_b$ and said virtual operating frictional force $F_v$ between said dummy wheels and the ground are a basis of said computational driving simulation.

17. The toy vehicle system of claim 1, wherein said control unit is arranged in said remote control transmitter.

18. The toy vehicle system of claim 17, wherein:

said control unit and said remote control transmitter form a component unit; and, said component unit is formed by a programmed smart phone, tablet or a mobile terminal device.

19. The toy vehicle system of claim 1, wherein:

said drive includes a first drive unit and a second drive unit;

said at least one steering device includes a first steering device and a second steering device;

said first drive unit includes said first drive motor, said first roller element and said first steering device;

said second drive unit includes said second drive motor, said second roller element and said second steering device;

said toy vehicle defines a center of gravity S;

one of said first drive unit and said second drive unit are arranged ahead of said center of gravity S with respect to said longitudinal vehicle axis and the other one of said first drive unit and said second drive unit is arranged behind said center of gravity S with respect to said longitudinal vehicle axis.

20. A toy system comprising:

a toy vehicle having a drive with a first and a second roller element configured to transfer frictional forces to a ground and a steering device;

a remote control transmitter;

a control unit configured to receive control input signals from said remote control transmitter and to generate control output signals configured to act on said drive and on the steering device;

said control unit being configured to call up a virtual adhesive force limit $F_m$ as well as a virtual sliding frictional force $F_g$ between said toy vehicle and the ground;

said virtual adhesive force limit $F_m$ being smaller than a corresponding actually transferable maximum frictional force between said first roller element and said second roller element and the ground;

said virtual sliding frictional force $F_g \leq$said virtual adhesive force limit $F_m$;

said control unit being configured for a computational driving simulation with incorporation of said control input signals of said remote control transmitter such that:

said control unit computationally determines an uncorrected operational frictional force $F_b$ acting between said toy vehicle and the ground, and compares said uncorrected operational frictional force $F_b$ to said virtual adhesive force limit $F_m$;

wherein, in a normal mode, in which said computationally determined uncorrected operational frictional force $F_b$ is less than said virtual adhesive force limit $F_m$, a driving behavior of said toy vehicle is computationally simulated under local action of a virtual operational frictional force Fat the level of said uncorrected operational frictional force $F_b$;

wherein, in a skidding mode, in which said computationally determined uncorrected operational frictional force $F_b$ is greater than said virtual adhesive force limit $F_m$, the driving behavior of said toy vehicle is simulated under local action of a virtual operational frictional force $F_v$ at the level of said virtual sliding frictional force $F_g$; and, said control unit is further configured to, from said computational driving simulation, generate control signals and have them act on said drive with said first roller element and said second roller element as well as said at least one steering device such that said toy vehicle performs a driving motion according to said computational driving simulation under action of said virtual operational frictional force $F_v$.

21. A method of operating a toy vehicle system, the toy vehicle system including a toy vehicle having a drive with first and second roller elements configured to transfer frictional forces to a ground and a steering device, a remote control transmitter, a control unit configured to receive control input signals from said remote control transmitter and to generate control output signals configured to act on said drive and on the steering device, said control unit being configured to call up a virtual adhesive force limit $F_m$ as well as a virtual sliding frictional force $F_g$ between said toy vehicle and the ground, said virtual adhesive force limit $F_m$ being smaller than a corresponding actually transferable maximum frictional force between said first roller element and said second roller element and the ground, said virtual sliding frictional force $F_g \leq$said virtual adhesive force limit $F_m$; and, said control unit being configured for a computational driving simulation with incorporation of said control input signals of said remote control transmitter such that the method comprises the steps of:

computationally determining an uncorrected operational frictional force $F_b$ acting between said toy vehicle and the ground via said control unit;

comparing said uncorrected operational frictional force $F_b$ to said virtual adhesive force limit $F_m$;

computationally simulating, in a normal mode wherein said computationally determined uncorrected operational frictional force $F_b$ is less than said virtual adhesive force limit $F_m$, a driving behavior of said toy vehicle under local action of a virtual operational frictional force $F_v$ at the level of said uncorrected operational frictional force $F_b$;

simulating, in a skidding mode wherein said computationally determined uncorrected operational frictional force $F_b$ is greater than said virtual adhesive force limit $F_m$, a driving behavior of said toy vehicle under local action of said virtual operational frictional force $F_v$ at the level of said virtual sliding frictional force $F_g$; and, generating control signals from said computational driving simulation via said control unit and having them act on said drive with said first roller element and said second roller element as well as said at least one steering device such that said toy vehicle performs a driving motion according to said computational driving simulation under action of said virtual operational frictional force $F_v$.

22. The method of claim 21, wherein said toy vehicle defines a longitudinal vehicle axis, the method further comprising the steps of:

deriving a frictional force in the direction of the longitudinal vehicle axis from a provided acceleration in the direction of the longitudinal vehicle axis; and, reducing the acceleration in the direction of the longitudinal vehicle axis to a limit acceleration which corresponds to said virtual sliding frictional force $F_g$ when said virtual adhesive frictional force $F_m$ is exceeded.

23. The method of claim 21, wherein said toy vehicle defines a longitudinal vehicle axis, the method further comprising the steps of:

deriving, when the toy vehicle is driving along a curve with a local radius r, an acceleration of the toy vehicle in the direction of the local radius r;

deriving a frictional force transverse to the longitudinal vehicle axis from the derived acceleration; and, acting on at least one of the drive and the steering device via the control unit such that the toy vehicle performs a local component of motion transverse to the longitudinal vehicle axis when the virtual adhesive frictional force $F_m$ is exceeded.

24. The method of claim 23, wherein the curve includes a local tangent t; the longitudinal vehicle axis is at a first angle $\alpha$ to the local tangent t in the normal mode; and, in the simulated sliding mode, the longitudinal vehicle axis is starting from said first angle $\alpha$ transferred to a second angle $\beta$ to the local tangent of the curve.

25. The method of claim 21, wherein the toy vehicle defines a longitudinal vehicle direction, the toy vehicle has at least two drive motors and at least two roller elements configured to transfer a drive torque to the ground, the roller elements being configured to be driven about corresponding rotational axes independently of each other via the at least two drive motors; and, the toy vehicle includes at least one steering device configured to adjust the orientation directions of the rotational axes relative to the longitudinal vehicle direction; and, the control unit is configured to act on said at least two drive motors and said at least one steering device.

26. The method of claim 22, wherein said toy vehicle defines a longitudinal vehicle axis, the method further comprising the steps of:

deriving, when the toy vehicle is driving along a curve with a local radius r, an acceleration of the toy vehicle in the direction of the local radius r;

deriving a frictional force transverse to the longitudinal vehicle axis from the derived acceleration; and, acting on at least one of the drive and the steering device via the control unit such that the toy vehicle performs a local component of motion transverse to the longitudinal vehicle axis when the virtual adhesive frictional force $F_m$ is exceeded.

* * * * *